US005112244A

United States Patent [19]

Kuzuno et al.

[11] Patent Number: 5,112,244

[45] Date of Patent: May 12, 1992

[54] TERMINAL CONNECTOR

[75] Inventors: Katsutoshi Kuzuno; Shigeo Ishizuka; Masayuki Yamamoto, all of Shizuoka, Japan

[73] Assignee: Yazaki Corporation, Japan

[21] Appl. No.: 680,416

[22] Filed: Apr. 4, 1991

[30] Foreign Application Priority Data

Apr. 6, 1990 [JP] Japan ..... 2-36562[U]

[51] Int. Cl.[5] ..... H01R 4/24

[52] U.S. Cl. ..... 439/395

[58] Field of Search ..... 439/389–425

[56] References Cited

U.S. PATENT DOCUMENTS

| | | | |
|---|---|---|---|
| 1,672,201 | 6/1928 | Champion . | |
| 2,630,468 | 3/1953 | Felts et al. . | |
| 3,914,004 | 10/1975 | Bone . | |
| 4,261,632 | 4/1981 | Narozny . | |
| 4,740,171 | 4/1988 | Holden et al. . | |
| 5,000,698 | 3/1991 | Kuzuno et al. | 439/395 |

FOREIGN PATENT DOCUMENTS

| | | |
|---|---|---|
| 56-1368 | 1/1981 | Japan . |
| 59-226476 | 12/1984 | Japan . |
| 60-91573 | 5/1985 | Japan . |

OTHER PUBLICATIONS

Japanese Laid-Open Publication 2-54168 to Katsutoshi Kuzuno et al., dated Apr. 19, 1990.

*Primary Examiner*—Joseph H. McGlynn
*Attorney, Agent, or Firm*—Wigman & Cohen

[57] ABSTRACT

A terminal connector to which an electrical wire having a conductor and an insulating cover surrounding the conductor is to be connected is disclosed. The terminal connector has a terminal body having an electrical connecting section to which a partner terminal is to be electrically connected and an electrical wire connecting section to which the electrical wire is to be connected, and a connecting member, which is separate from the terminal body, adapted to be mounted to the wire connecting section to establish electrical connection between the conductor of the electrical wire and the terminal body when the connecting member is mounted to the wire connecting section. The wire connecting section includes a base plate having opposite edges along the elongated direction of the terminal body and side walls integrally formed on the respective edge of the base plate. The side wall portions are opposite with each other in such a manner that the electrical wire will be received therebetween when the electrical wire is connected to the wire connecting section and that the connection member is fitted therebetween when the connecting member is mounted to the wire connecting section. The wire connecting section further includes first portion provided between the side walls for supporting the electrical wire thereon when the electrical wire is connected, and second portion for supporting the electrical wire thereon, the second portion being provided on the front or rear side of the first supporting portion with spaces defined between the first portion and each of the second portions into which the connecting member is adapted to be inserted.

19 Claims, 5 Drawing Sheets

TERMINAL CONNECTOR

BACKGROUND OF THE INVENTION

1. Field of the Invention

This invention relates to a terminal connector, and in particular to a terminal connector to which an electrical wire with an insulating cover can be electrically connected without stripping the insulating cover in advance of the connecting operation of the wire to the terminal.

2. Description of the Prior Art

Conventionally, as such a terminal connector mentioned above, there is known a terminal connector as disclosed in Japanese Laid-open Patent Publication No. 59-226476. The conventional terminal connector is illustrated in FIGS. 1 and 2.

The conventional connector 1 has a terminal body 2 which is formed by punching a conductive metal plate and then bending it. The terminal body 2 includes an electrical connecting section 3 at a front side thereof to which a partner terminal connector (not shown) is electrically to be connected and a wire connecting section 4 at a rear side thereof to which an electrical wire 5 having a conductor 5*a* and an insulating cover 5*b* surrounding the conductor 5*a* is electrically to be connected by means of a connecting member 6.

The wire connecting section 4 includes a base plate portion 4*a* and two clamping wall portions 4*b* and 4*c* erectly formed on the opposite sides of the base plate portion 4*a* in the elongated direction of the terminal body 2, respectively. In FIG. 1, the width of the base plate portion 4*a* which is measured between the clamping wall portions 4*b* and 4*c* is indicated by the letter "W1", and the length of the base plate portion 4*a* which is corresponding to the length of each of the clamping wall portions 4*b* and 4*c* in the elongated direction of the terminal body 2 is indicated by the letter "L1".

The connecting member 6 comprises a C-shaped member having a base plate portion 6*a* and first and second erected wall portions 6*b* and 6*c* provided on opposite sides of the base plate portion 6*a*. The width "W2" of the base plate portion 6*a* of the connecting member 6 which is corresponding to the width of each or the erected wall portions 6*b* and 6*c* is slightly shorter than the width "W1" of the base plate portion 4*a* of the wire connecting section 4, and the distance "L2" which is measured between the first and second erected wall portions 6*b* and 6*c* is slightly longer than the length "L1" of the base plate portion 4*a* of the wire connecting section 4.

The first erected wall portion 6*b* has a recess 7*b* into which the insulating cover 5*b* of the electrical wire 5 is tightly secured. The second erected wall portion 6*c* also has a recess 7*c*, of which width is narrower than that of the recess 7*b* of the former wall portion 6*b*, into which the conductor 5*a* of the electrical wire 5 is tightly secured to establish an electrical connection between the connecting member 6 and the conductor 5*a* of the wire 5.

In use of the terminal connector 1, as shown in FIG. 1, first the connecting member 6 constituted as described above is put on the wire connecting section 4 of the terminal body 2 in such a manner that the first and second erected wall portions 6*b* and 6*c* thereof are aligned along the elongated direction of the terminal body 2. Then, as shown in FIG. 2, by clamping the clamping wall portions 4*b* and 4*c* of the wire connecting section 4 so as to engage with the base plate portion 6*a* of the connecting member 5, respectively, the connecting member 6 is mounted to the wire connecting section 4. Then, the electrical wire 5 is attached to the connecting member 6 already mounted to the terminal body 2 by pressurizingly inserting the electrical wire 5 into the recesses 7*b* and 7*c* of the first and second wall portions 6*b* and 6*c* of the connecting member 6. In this case, the insulating cover 5*b* of the electrical wire 5 is tightly secured within the recess 7*b* of the first wall portion 6*b* of the connecting member 6. On the other hand, since the width of the recess 7*c* of the second wall portion 6*c* is smaller than that of the recess 7*b* of the first wall portion 6*b*, the insulating cover 5*b* is stripped when it is pressurizingly inserted into the recess 7*c* of the second wall portion 6*c* with a specific pusher (not shown), so that the conductor 5*a* of the electrical wire 5 is brought into contact with the inner surface of the recess 7*c* of the second wall portion 6*c* to establish an electrical connection between the electrical wire 5 and the connecting member 6. As a result, an electrical connection between the electrical wire 5 and the terminal connector 1 is established.

In the conventional terminal connector as described above, however, there are disadvantages such as follows. Namely, in the conventional terminal connector 1, since two processes that mounts the connecting member 6 to the wire connecting section 4 of the terminal body 2 and then connects the electrical wire 5 to the connecting member 6 at the two recesses 7*b* and 7*c* are required in order to connect the electrical wire 5 to the terminal connector 1, it is difficult to improve operation efficiency for the connection, which results in increase of manufacturing cost thereof. Further, in the conventional terminal connector 1, it is required to prepare the specific pusher which pressurizingly inserts the wire into the recesses 7*b* and 7*c* when the wire 5 is electrically connected to the connecting member 6. The pusher requires to have a specific mechanism since a diameter of a wire to be connected is relatively too small. Therefore, the cost for preparing the machine is relatively expensive, thus also leading to cost up in the manufacturing the terminals.

SUMMARY OF THE INVENTION

In view of the above disadvantages of the conventional terminal connector, a main object of the present invention is to improve operation efficiency at the time when an electrical wire is electrically connected to a connector terminal to reduce manufacturing cost thereof.

Another object of the present invention is to increase contact area between the connecting member and the electrical wire connecting section to obtain reliable electrical connection therebetween.

In order to achieve the main object, a terminal connector according to the present invention comprises a terminal body having an electrical connecting section to which a partner terminal is to be electrically connected and an electrical wire connecting section to which an electrical wire is to be connected, and a connecting member, which is separate from the terminal body, adapted to be mounted to the wire connecting section to establish electrical connection between a conductor of the electrical wire and the wire connecting section when the connecting member is mounted to the wire connecting section. The electrical wire connecting section includes a base plate having opposite edges along the elongated direction of the terminal body and side walls integrally formed on the respective edge of the base plate. The side walls are opposite with each other in such a manner that the electrical wire will be received between the wall portions when the electrical wire is connected to the wire connecting section and that the connecting member is fitted between the side walls to establish electrical connection therebetween when the connecting member is mounted to the wire connecting section. The wire connecting section further includes first means provided between the side walls for supporting the electrical wire thereon when the electrical wire is connected, and second means for supporting the electrical wire thereon, the second wire supporting means being provided on the front and rear sides of the first supporting means with spaces between the first wire supporting means and each of the second wire supporting means into which the connecting member is adapted to be inserted.

According to the terminal connector of the present invention as described above, electrical connection between the electrical wire and the terminal connector can be accomplished substantially at the same time of mounting the connecting member to the wire connecting section of the terminal connector. Therefore, it becomes possible to reduce the number of processes for connecting the electrical wire to the terminal connector in comparison with those required in the conventional terminal connector as described above. As a result, operation efficiency in the connecting operation of the electrical wire to the terminal connector can be improved. Further, this also results in decreasing the manufacturing cost thereof.

The connector terminal according to the present invention may be further provided with means for increasing contact area between the the connecting member and the electrical wire connecting section. The contact area increasing means may be constituted from protrusions formed on the connecting member or the second wire supporting means in such a manner that the protrusions come to contact with the second wire supporting means or the connecting member As a result, reliable electrical connection can be obtained between the connecting member and the terminal body. Further, the connecting member can be securely mounted with respect to the wire connecting section.

These and other objects, features and advantages of the present invention will be more apparent from the following descriptions of preferred embodiments, taken in conjunction with the accompanying drawings.

DETAILED DESCRIPTION OF THE PREFERRED EMBODIMENTS:

Now, with reference to the accompanying drawings, preferred embodiments of the present invention will be described.

Figure 3:
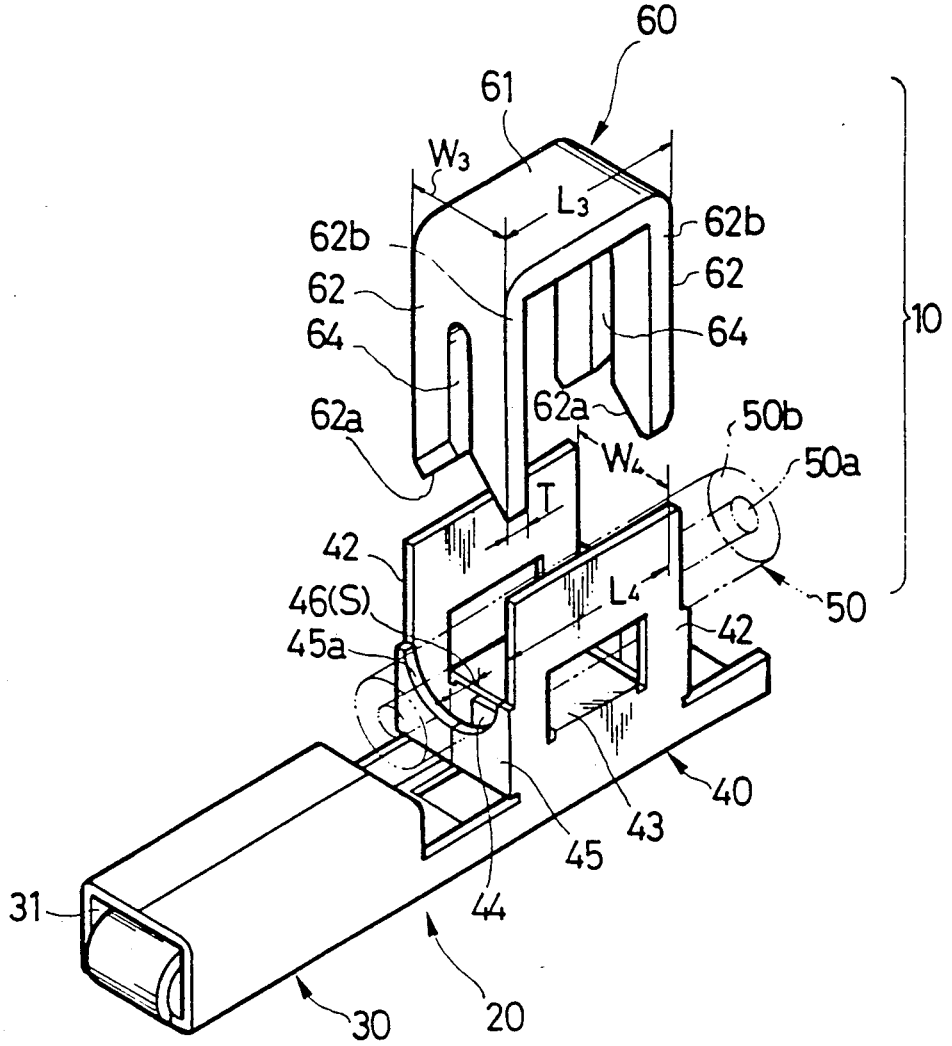
FIG. 3 is a disassembled perspective view of a first embodiment of a terminal connector according to the present invention.
Figure 4:
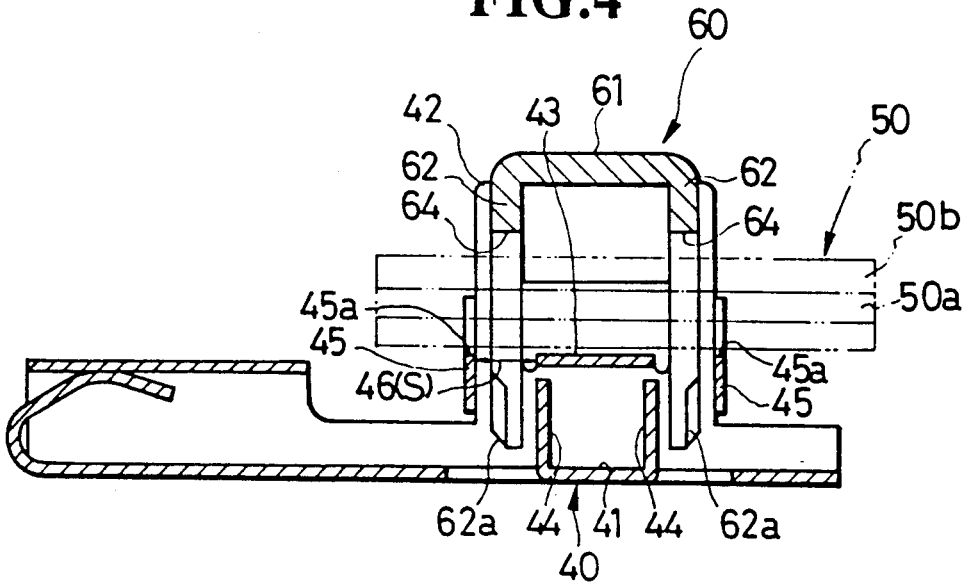
FIG. 4 is a sectional view of the terminal connector of FIG. 3.

FIGS. 3 and 4 show the first embodiment of the terminal connector according to the present invention.

In the figures, the reference numeral 10 denotes the terminal connector of this embodiment. The terminal connector 10 comprises a terminal body 20 which has at a front side thereof an electrical connecting section 30 to which a partner terminal (not shown) is electrically connected and at a rear side thereof an wire connecting section 40 to which an electrical wire 50 having a conductor 50*a* and an insulating cover 50*b* surrounding the conductor 50*a* is to be connected.

The electrical connecting section 30 comprises a tab receptacle 31 into which a male tab (not shown) of the partner terminal is fitted to establish electrical connection therebetween.

The wire connecting section 40 comprises a base plate 41 having opposite edges along the elongated direction of the terminal body 20. Two side walls 42 are integrally formed on the respective edge of the base plate 41 in such a manner that each of the side walls 42 is perpendicular to the base plate 41. The side walls 42 are opposite to each other in such a manner that the electrical wire 50 will be received between the walls 42 when the wire 50 is connected to the connector terminal 10.

Between the side walls 42, there is formed a wire supporting plate 43 so as to bridge between the side walls 42 in such a manner that the electrical wire 50 is supported thereon when the electrical wire 50 is connected to the connector terminal. The wire supporting plate 43 is formed by punching a part of the respective side wall 42 and then bending it inwardly such that the parts of the side walls 42 are connected to form a plate-like portion.

Just below the wire supporting plate 43, there are formed two erected walls 44 which serve to support the wire supporting plate 43 from the underside thereof. Each of the erected walls 44 is formed by punching a part of the base plate 41 and then bending it perpendicular to the base plate 41 in such a manner that the erected walls 44 are opposite to each other in the elongated direction of the terminal body 20.

On the front and rear sides of the wire supporting plate 43, there are provided wire supporting walls 45 through a space 46 between each of the wire supporting walls 45 and the wire supporting plate 43. The wire supporting walls 45 also serve to support the wire when it is connected to the connector terminal. Each of the wire supporting walls 45 is formed by bending extending portions of each side wall inwardly so as to be perpendicular to each side wall 42. Each of the wire supporting walls 45 has an upper edge 45*a* which has a concave arched-shape. Each of the center portions of the arched edges is situated substantially at the same height as that of the first wire supporting plate 43. This arched edge 45*a* serves to automatically center the wire 50 to be mounted with respect to the wire mounting section 40.

Figure 1:
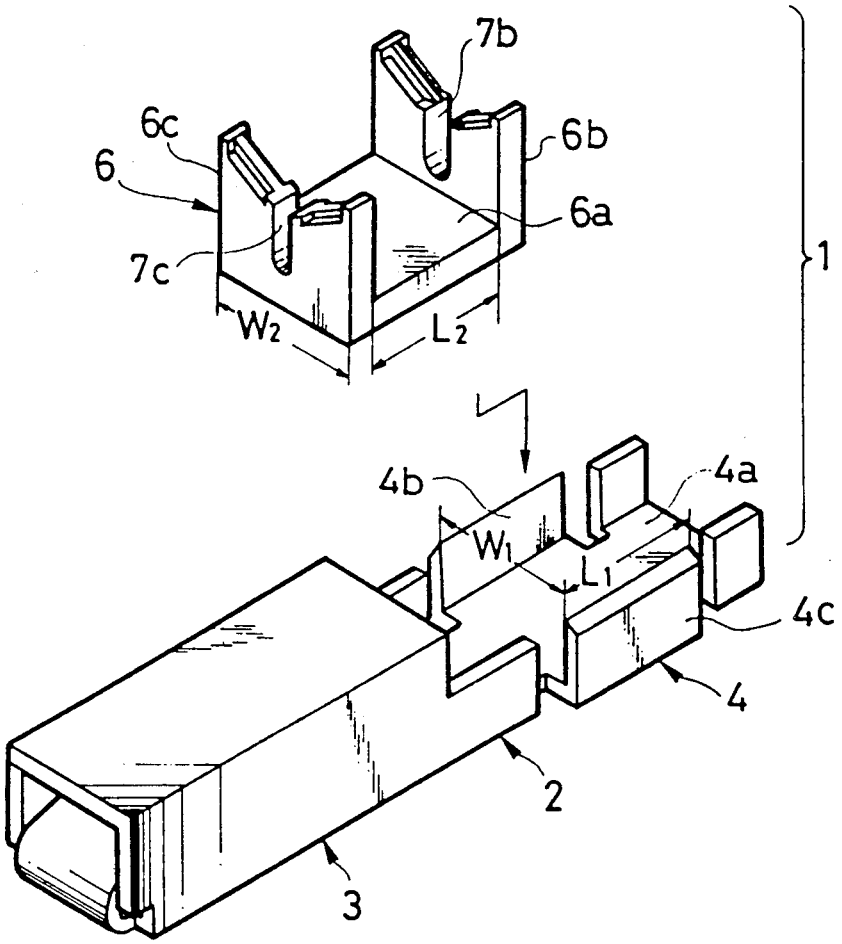
FIG.1 PRIOR ART
FIG. 1. is a disassembled perspective view of the conventional connector terminal.
Figure 2:
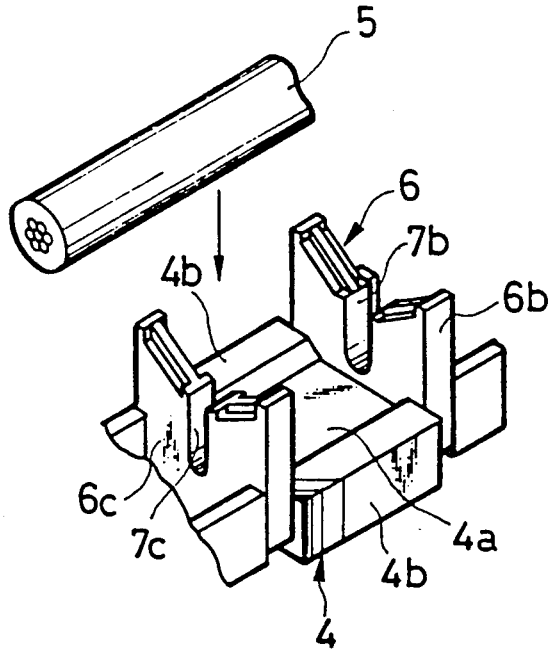
FIG.2 PRIOR ART
FIG. 2 is a perspective view of the main part of the conventional connector terminal shown in FIG. 1.

In the figures, the reference numeral 60 indicates a connecting member. The connecting member 60 is separate from the terminal body 20, and is adapted to be mounted to the wire connecting section 40 to establish electrical connection between the conductor 50*a* of the electrical wire 50 and the wire connecting section 40 when the connecting member 60 is properly mounted to the wire connecting section 40. The connecting member 60 includes a base plate part 61 and tow leg parts 62 which perpendicually extend from front and rear edges of the base plate part 61 so as to form a U-shaped configuration as a whole. The leg parts 62 of the connecting member 60 are adapted to be inserted into the spaces 46 which is defined between the wire supporting plate 43 and each of the wire supporting walls 45, respectively. Each of the leg parts 62 has a recess 64 extending from a tip part 62*a* thereof along its center. As clearly illustrated in FIG. 1, at the tip part 62*a* of each leg part 62 of the connecting member 60, there is formed an inclined edge for cutting or stripping the insulating cover 50*b* of the electrical wire 50. The width of the recess 64 is slightly smaller than the diameter of the conductor 50*a* in order to achieve good electrical connection therebetween. In this regards, it should be noted that the width of the recess 64 and the thickness of the connecting member 50 are changed in accordance with a size of an electrical wire to be connected to the terminal connector.

The connecting member 60 has the following size and dimension. Namely, the width of the connecting member 60 which is indicated by the letter "W3" is substantially the same as the distance between the side walls 42 which is indicated by the letter "W4". The thickness of the leg part 62 of the connecting member 60 which is indicated by the letter "T" is less than the width of the space 46(S) which is defined between the wire supporting plate 43 and each of the wire supporting walls 45. As a result, thus constituted connecting member 60 will be tightly inserted between the side walls 42 to establish good electrical connection therebetween when it is mounted to the wire connecting section 40.

In use of the connector terminal 10 having the above structure, first the end portion of the electrical wire 50 is put onto the wire connecting section 40 in such a manner that the end portion is laid onto the wire supporting plate 43 and wire supporting walls 45 as indicated by the phantom line in FIG. 3. Then, the connecting member 60 having the recesses 64 which are suitable to the size of the conductor 50*a* of the wire 50 is pressed to the wire connecting section 40 from the upper side of the wire connecting section 40 in such a manner that the the leg parts 62 of the connecting member 60 are inserted into the spaces 46(S) defined between the wire supporting plate 43 and each of the wire supporting walls 45. In this case, since the wire 50 has been centered with respect to the space defined between the two side walls 42 due to the arched edges 45*a* of the wire supporting walls 45, the recesses 46 of the connecting member 60 are accurately positioned with respect to the position of the conductor 50*a* of the wire 50.

During this inserting and mounting operation of the connecting member 60, the insulating cover 50*b* of the electrical wire 50 is cut or stripped by the edges formed on the tips 62*a* of the leg parts 62 of the connecting member 60. Then, the conductor 50*b* of the electrical wire 50 is tightly fitted within the recesses 64 of the connecting member 60, so that the electrical wire 50 is secured to the connecting member 60. In this condition, as shown in FIG. 4, electrical connection between the conductor 50*a* of the electrical wire 50 and the connecting member 60 is also achieved. Further, in this condition, because the connecting member 60 is tightly fitted between the side walls, the connecting member 40 is securely mounted to the wire connecting section 40 of the terminal body 20. At the same time, electrical connection between the terminal body 20 and the connecting member 60 is also achieved. As a result, electrical connection between the electrical wire 50 and the terminal body 20 is also established through the connecting member 60. In this case, since each of the leg parts 62 of the connecting member 60 is held between the side wall portions, it is possible to prevent the recesses 64 of the connecting member 60 open outwardly.

According to the embodiment as described above, the electrical wire 50 can be secured and electrically connected to the terminal body 60 during the mounting operation of the connecting member 60 to the wire connecting section 40 of the terminal body 20. In other words, the electrical wire 50 can be secured and electrically connected to the terminal body 20 substantially at the same time of mounting the connecting member 60 to the terminal body 20. Therefore, the operation efficiency at the connection of the electrical wire 50 to the terminal body 20 is remarkably improved in comparison with the conventional terminal connector.

Further, in the mounting operation of the connecting member 60 to the wire connecting section 40, it is enough to prepare a machine which simply pushes the connecting member 60 toward the terminal body 20. The machine does not need to have a complicated mechanism like that required in the machine used in the conventional connector terminal described above, the cost required for the manufacturing equipments can be reduced, thus leading to cost down.

Furthermore, under the mounting condition of the connecting member 60 to the electrical wire connecting section 40, each of the recesses 64 of the connecting member 60 is normally being narrowed from the opposite sides thereof by the side walls 42 of the electrical wire connecting section 40. Therefore, good electrical connection between the conductor 50*a* of the wire 50 and the connecting member 60 will be kept, even if the recesses 64 are loosingly opened during long time use thereof or a wire having a relatively thick conductor is used.

In the foregoing embodiment, it is possible to constitute the connecting member 60 in such a manner that the length "L3" is substantially the same as the distance "L4" between the inner surfaces of the wire supporting walls 45. If so, when the connecting member 60 is properly mounted to the wire connecting section 40 of the terminal body 20, the outer surfaces of the leg parts 62 of the connecting member 60 come to contact with the inner surfaces of the wire supporting walls 45. As as result, the electrical contact area between the connecting member 60 and the wire connecting section 40 is increased, thus providing more reliable electrical connection therebetween.

Figure 5:
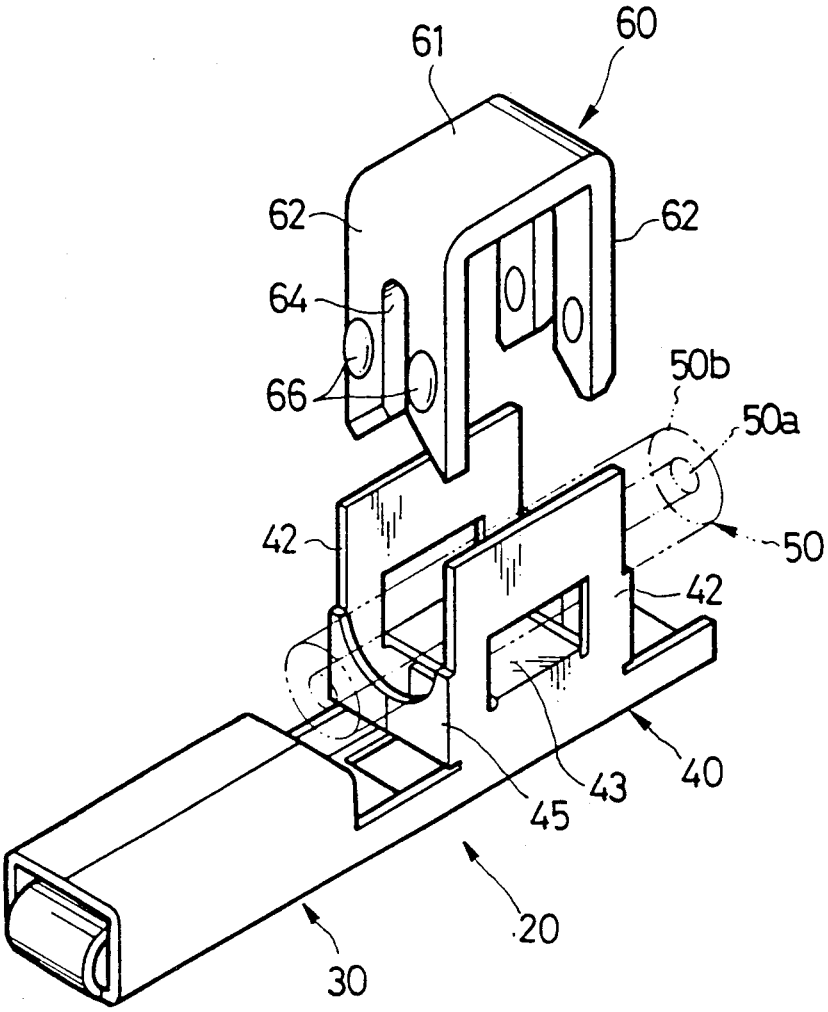
FIG. 5 is a disassembled perspective view of a second embodiment of the terminal connector according to the present invention.
Figure 6:
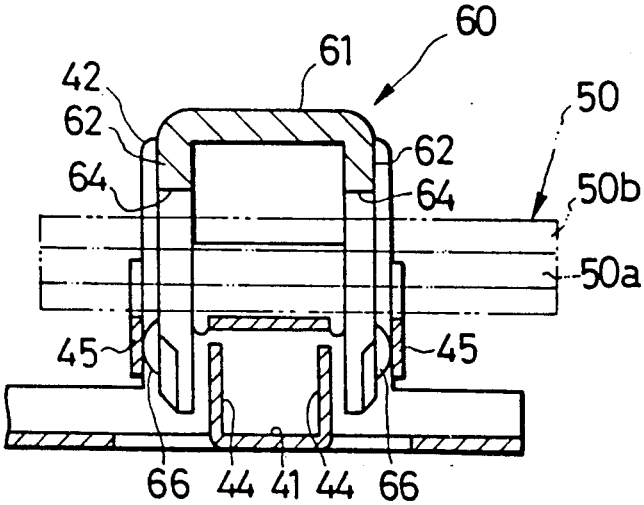
FIG. 6 is a sectional view of the main part of the terminal connector of FIG. 5.

FIGS. 5 and 6 show the second embodiment of the present invention. In this second embodiment, most of the structure is same as that of the first embodiment. Therefore, it is believed that detailed descriptions of the structure of the second embodiment can be omitted by allotting the same reference numerals as those of the first embodiment to the common components.

The feature of the second embodiment resides in the provision of protrusions 66 which are formed on the outer surfaces of the leg part 62 of the connecting member 60 as clearly shown in FIG. 5. The protrusions 66 each of which has a substantially hemisphere shape come to contact with the inner surfaces of the wire supporting walls 45 when the connecting member 60 is properly mounted to the wire connecting section 40 of the terminal body 20.

According to the second embodiment, contact area between the connecting member 60 and the wire connecting section 40 is increased due to the contacts between the protrusions 66 of the connecting member 60 and the wire supporting walls 45, which results in more reliable electrical connection therebetween. In addition to this, the connecting member 60 is held with respect to the wire connecting section 40 not only between the side walls 42 but also between the wire supporting walls 45. Therefore, the connecting member 60 can be securely mounted to the wire connecting section 40. In particular, even if the leg parts 62 would be deformed and therefore the recesses open, the electrical connection made between each of the leg parts 62 and each of the wire supporting walls 45 will not be affected by the deformation of the connecting member 60, so that it is possible to continuously provide reliable electrical connection therebetween.

Figure 7:
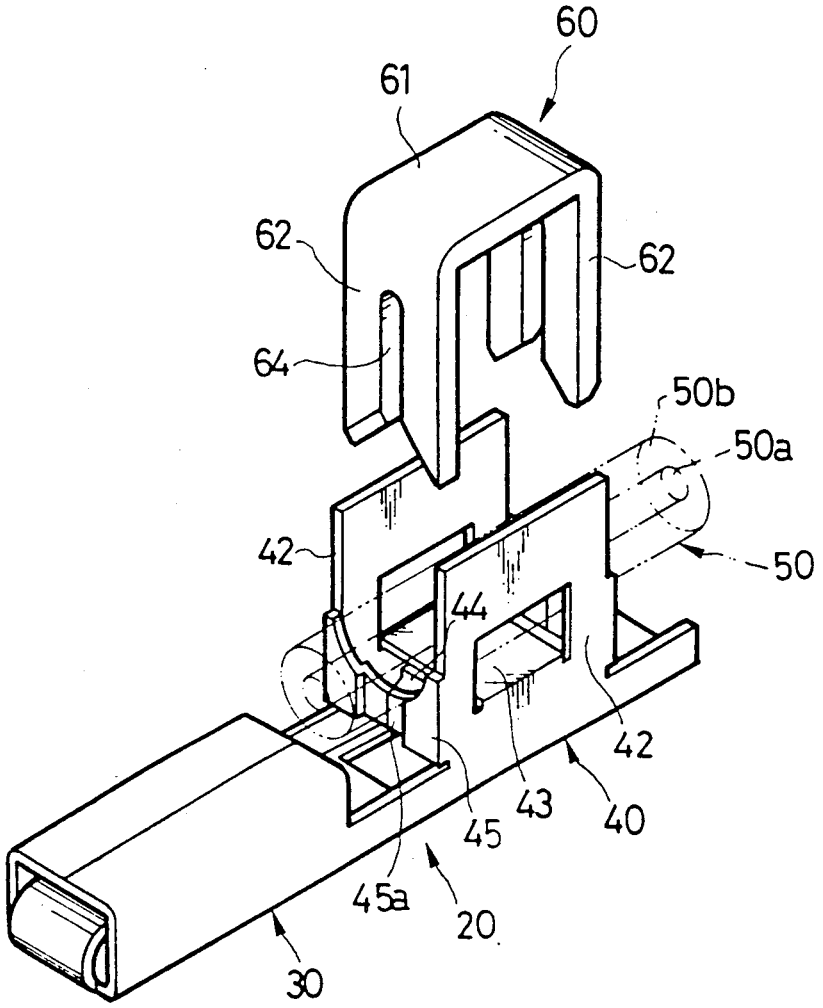
FIG. 7 is a disassembled perspective view of a third embodiment of the terminal connector according to the present invention.
Figure 8:
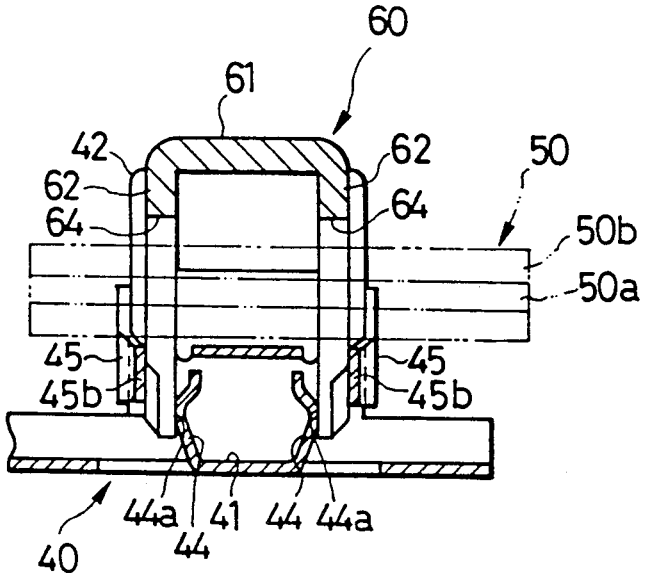
FIG. 8 is a sectional view of the main part of the terminal connector of FIG. 7.

FIGS. 7 and 8 show the third embodiment of the present invention. Since the structure of the third embodiment is substantially the same as that of the first embodiment excepting those of the erected walls and wire supporting walls, the detailed descriptions of the common structure has been omitted by allotting the same reference numerals to the common components.

The feature of the third embodiment resides in the provisions of a protrusion formed on each of the wire supporting walls 45 and the configuration of each erected wall 44. Namely, in this embodiment, each of the wire supporting walls 45 has a protrusion **45*b* which is inwardly protruded toward the wire supporting plate 43. Further, each of the erected walls 44 is bent so as to have a substantially C-shape configuration in such a manner that it is elastically protruded toward each of the wire supporting walls 45. In other words, the protrusion 45*b* formed on the wire supporting walls 45 and the erected walls 44 are protruded into the space defined therebetween so as to narrow it. As a result, each of the leg parts 62 of the connecting member 60 comes to contact with them at the inner and outer surfaces thereof when the connecting member 60 is properly mounted to the wire connecting section 40**, which results in providing more reliable electrical connection therebetween. Further, it appears that this embodiment also has the same advantage as that of the second embodiment.

Figure 9:
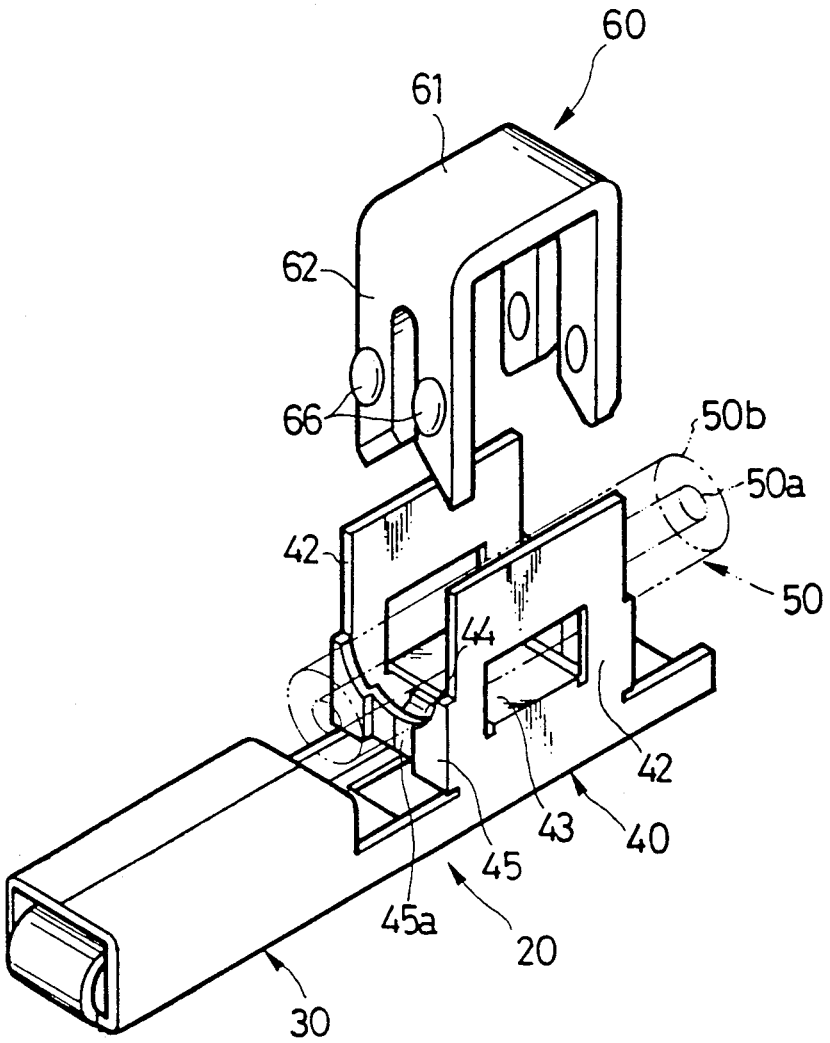
FIG. 9 is a disassembled perspective view of a forth embodiment of the terminal connector according to the present invention.
Figure 10:
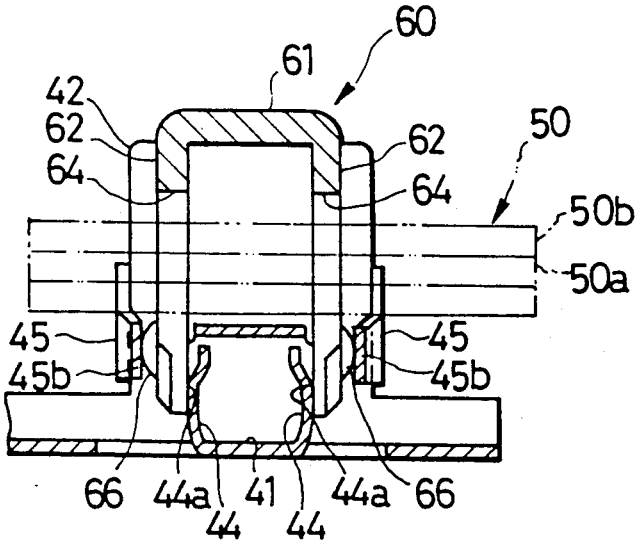
FIG. 10 is a sectional view of the main part of the terminal connector of FIG. 9.

FIGS. 9 and 10 show the fourth embodiment of the present invention. As see from these figures, the embodiment is a combination of the second and third embodiments. Therefore, detailed explanation of this embodiment has been omitted by allotting the same reference numerals as those of the second and third embodiments to the corresponding components of this embodiment. According to this embodiment, it also appears that this embodiment can have the same advantages as those of the second and third embodiments.

Finally, it should be noted that in the first and second embodiments, it is possible to remove the wire supporting plate 43 and substitute it with the erected walls 44. Further, it should also be noted that in the third and fourth embodiments, the elastic contacts formed from the erected walls 44 are formed by punching a part of each side wall and then bending it so as to have that configuration. Furthermore, in the foregoing embodiments, although the terminal connector is formed as a female terminal, it is appears that the terminal can be constituted as a male terminal.

It will be apparent from the foregoing description that the terminal connector of the present invention has a number of advantages, some of which have been described above. Also, obvious modifications and variations can be made to the terminal connector of the present invention without departing from the scope of the invention. Accordingly, the scope of the invention is not limited as necessitated by the accompanying claims.

What is claimed is:

1. A terminal connector to which an electrical wire having a conductor and an insulating cover surrounding the conductor is to be connected, which comprises:

a terminal body having an electrical connecting section to which a partner terminal is to be electrically connected and a wire connecting section to which the electrical wire is to be connected; and a connecting member, which is separate from the terminal body, adapted to be mounted to the wire connecting section to establish electrical connection between the conductor of the electrical wire and the wire connecting section when the connecting member is mounted to the wire connecting section;

wherein the electrical wire connecting section comprises:

a base plate having opposite edges along the elongated direction of the terminal body;

side walls integrally formed on the respective edge of the base plate, the side walls being opposite with each other in such a manner that the electrical wire is received therebetween when the electrical wire is connected to the wire connecting section and that the connecting member is fitted therebetween when the connecting member is mounted to the wire connecting section;

first means provided between the side walls for supporting the electrical wire thereon when the electrical wire is connected to the wire connecting section, the first wire supporting means having front and rear sides; and second means for supporting the electrical wire thereon, the second wire supporting means being provided on the front and rear sides of the first wire supporting means through spaces defined between the first wire supporting means and each of the second wire supporting means, respectively, and the connecting member being adapted to be inserted into the spaces when the connecting member is mounted to the wire connecting section.

2. A terminal connector as claimed in claim 1, wherein the first wire supporting means comprises a pair of wall parts formed on the base plate of the wire connecting section and between the side walls thereof.

3. A terminal connector as claimed in claim 1, wherein the first wire supporting means comprises a plate-like portion bridging between the side walls.

4. A terminal connector as claimed in claim 3, wherein the plate-like portion is formed by punching a part of each side wall and then bending it inwardly.

5. A terminal connector as claimed in claim 1, wherein each of the side walls has front and rear edges, and the second wire supporting means comprises two wall portions each connected between the front edges of the side walls and between the rear edges of the side walls, respectively.

6. A terminal connector as claimed in claim 5, wherein the second wire supporting means having means for centering the electrical wire to be put on the wire connecting section between the side walls.

7. A terminal connector as claimed in claim 6, wherein each of the wall portions of the second wire supporting means has an upper edge and the centering means comprises the upper edge formed into a concave arched-shape.

8. A terminal connector as claimed in claim 7, wherein the plate-like portion of the first wire supporting means has an upper surface thereof, and the concave arch of each wall portion of the second wire supporting means has the lowest portion, in which the upper surface of the plate-like portion is situated substantially at the same height as that of the lowest portion of the concave arch of the second wire supporting means.

9. A terminal connector as claimed in claim 8, wherein the connecting member comprises two leg portions which are inserted into the spaces defined between the first wire supporting means and each of the second wire supporting means, respectively, when the connecting member is mounted to the wire connecting section, each of the leg parts having a tip portion and a recess extending from the tip portion thereof, the recess having a width such that a portion of the recess width is slightly smaller than the diameter of the conductor of the electrical wire, and the conductor of the electrical wire is adapted to be secured therein to establish electrical connection between the conductor and the connecting member.

10. A terminal connector as claimed in claim 9, wherein the connecting means further comprises a base plate connecting the leg portions so as to form a substantially U-shape configuration as a whole.

11. A terminal connector as claimed in claim 10, wherein the tip portion of each of the leg parts of the connecting member has an inclined edge for cutting or stripping the insulating cover of the electrical wire laid on the first and second wire supporting means when the connecting member is mounted to the wire connecting section.

12. A terminal connector as claimed in claim 11, wherein each of the leg parts of the connecting member has a width which is substantially corresponding to the distance between the side walls so as to establish reliable electrical connection between the connecting member and the wire connecting section.

13. A terminal connector as claimed in claim 11, wherein each of the leg parts of the connecting member has inner and outer surfaces, and the contact area increasing means is the arrangement of the two leg parts of the connecting member in which the outer surfaces of the leg parts of the connecting member come to contact with the second wire supporting means when the connecting member is mounted to the wire connecting section.

14. A terminal connector as claimed in claim 1, wherein the electrical wire connecting section further comprises means for increasing contact area between the connecting member and the electrical wire connecting section.

15. A terminal connector as claimed in claim 14, wherein the contact area increasing means includes at least one protrusion formed on the outer surface of each of the leg parts of the connecting member in such a manner that the protrusions come to contact with the second means when the connecting member is mounted to the wire connecting section.

16. A terminal connector as claimed in claim 14, wherein the contact area increasing means includes a protrusion formed on each of the second means so as to protrude into the respective space in such a manner that the protrusions come to contact with the outer surfaces of the leg parts of the connecting member, respectively, when the connecting member is mounted to the wire connecting section.

17. A terminal connector as claimed in claim 14, wherein the contact area increasing means includes elastic contacts formed on the base plate portion of the wire connecting section in such a manner that the elastic contacts come to contact with the inner surfaces of the leg parts of the connecting member when the connecting member is mounted to the wire connecting section.

18. A terminal connector as claimed in claim 14, wherein the contact area increasing means comprises a protrusion formed on each of the second means so as to protrude into the respective space in such a manner that the protrusions come to contact with the outer surfaces of the leg parts of the connecting member when the connecting member is mounted to the wire connecting section, and elastic contacts formed on the base plate portion of the wire connecting section in such a manner that the elastic contacts come to contact with the inner surfaces of the leg parts of the connecting member when the connecting member is mounted to the wire connecting section.

19. A terminal connector as claimed in claim 18, wherein the contact area increasing means further comprises at least one protrusion formed on the outer surface of each of the leg parts of the connecting member in such a manner that the protrusions come to contact with the protrusions of the second means, respectively, when the connecting member is mounted to the wire connecting section.

* * * * *